US008797259B2

(12) United States Patent
Yoshida

(10) Patent No.: US 8,797,259 B2
(45) Date of Patent: Aug. 5, 2014

(54) ELECTROPHORETIC DISPLAY DEVICE DRIVING METHOD, ELECTROPHORETIC DISPLAY DEVICE, AND ELECTRONIC APPARATUS

(75) Inventor: Junpei Yoshida, Chino (JP)

(73) Assignee: Seiko Epson Corporation, Tokyo (JP)

( * ) Notice: Subject to any disclaimer, the term of this patent is extended or adjusted under 35 U.S.C. 154(b) by 907 days.

(21) Appl. No.: 12/724,828

(22) Filed: Mar. 16, 2010

(65) Prior Publication Data

US 2010/0238158 A1 Sep. 23, 2010

(30) Foreign Application Priority Data

Mar. 23, 2009 (JP) ..... 2009-070191

(51) Int. Cl.
*G09G 3/34* (2006.01)
*G09G 3/16* (2006.01)

(52) U.S. Cl.
CPC ..... *G09G 3/16* (2013.01); *G09G 2320/046* (2013.01); *G09G 3/344* (2013.01); *G09G 2320/0271* (2013.01); *G09G 2320/041* (2013.01)
USPC ..... 345/107; 345/214

(58) Field of Classification Search
CPC ..... G09G 3/16; G09G 3/344
USPC ..... 345/107, 204, 209, 210, 214
See application file for complete search history.

(56) References Cited

U.S. PATENT DOCUMENTS

| | | | | |
|---|---|---|---|---|
| 6,219,019 | B1 * | 4/2001 | Hasegawa et al. | 345/96 |
| 7,057,600 | B2 * | 6/2006 | Goden | 345/107 |
| 7,528,822 | B2 * | 5/2009 | Amundson et al. | 345/107 |
| 2004/0119680 | A1 * | 6/2004 | Daniel et al. | 345/107 |
| 2006/0221049 | A1 * | 10/2006 | Miyasaka et al. | 345/107 |
| 2006/0274030 | A1 * | 12/2006 | Johnson et al. | 345/107 |
| 2006/0291122 | A1 * | 12/2006 | Zhou et al. | 361/103 |
| 2007/0146306 | A1 * | 6/2007 | Johnson et al. | 345/107 |
| 2008/0238865 | A1 * | 10/2008 | Maeda | 345/107 |
| 2008/0238867 | A1 * | 10/2008 | Maeda et al. | 345/107 |
| 2009/0046114 | A1 * | 2/2009 | Lee et al. | 345/691 |
| 2010/0060789 | A1 | 3/2010 | Aoki et al. | |

FOREIGN PATENT DOCUMENTS

| | | | |
|---|---|---|---|
| JP | 09-050258 | A | 2/1997 |
| JP | 2004-219715 | A | 8/2004 |
| JP | 2007-501436 | A | 1/2007 |
| JP | 2007-187936 | A | 7/2007 |
| JP | 2007-187938 | A | 7/2007 |
| JP | 2007-519045 | A | 7/2007 |
| WO | WO-2004-104977 | A | 12/2004 |
| WO | WO-2005-071650 | A | 8/2005 |
| WO | WO-2009-028160 | A | 3/2009 |

* cited by examiner

*Primary Examiner* — Pegeman Karimi
(74) *Attorney, Agent, or Firm* — ALG Intellectual Property, LLC

(57) ABSTRACT

There is provided a method of driving an electrophoretic display device including a display unit in which an electrophoretic element containing electrophoretic particles is interposed between first and second substrates and in which a plurality of pixels are arranged. The method includes lowering a contrast of the display unit, when a predetermined non-operation period elapses after the display unit displays an image.

20 Claims, 8 Drawing Sheets

ELECTROPHORETIC DISPLAY DEVICE DRIVING METHOD, ELECTROPHORETIC DISPLAY DEVICE, AND ELECTRONIC APPARATUS

BACKGROUND

1. Technical Field

The present invention relates to an electrophoretic display device driving method, an electrophoretic display device, and an electronic apparatus.

2. Related Art

A display device of which a representative example is a liquid crystal display device with the characteristics of a thin shape, a lightweight, and low power consumption. Therefore, the display device expected to achieve clear display as an image display device has currently been developed in the fields of an OA apparatus, an information terminal, a watch, a television, and the like.

On the other hand, an electronic paper device of which a representative example is an electrophoretic display (EPD) has characteristics of thinness, lightness, and low power consumption like paper. Therefore, the electronic paper device has rapidly been developed as a paper capable of executing a rewriting operation.

A microcapsule type EPD which is a representative electrophoretic display device is a display unit which includes microcapsules enclosing a liquid in which charged particles are dispersed and realizes a contrast by applying a voltage to electrodes interposing the microcapsules to generate an electric field and by varying the distribution of the charged particles.

In such an electrophoretic display device, a migration speed of the charged particles in an electrophoretic element depends on temperature. For this reason, for example, JP-T-2007-501436 discloses a technique of expanding a driving voltage for the electrophoretic element and prolonging an application time in a low temperature environment. In JP-A-2007-187936 and JP-A-2007-187938, an operation is repeated in every writing time to ensure a display maintaining ability.

However, when the electrophoretic display device is left in an arbitrary display state for a long time, a defect (burn-in) may occur in that the image vaguely remains even when the display is updated. The burn-in shows a tendency to occur depending on temperature. For example, the electrophoretic display device is left at a high temperature environment of about 70° C., the burn-in occurs for several hours.

According to the techniques disclosed in JP-T-2007-501436, JP-A-2007-187936, and JP-A-2007-187938, a variation in the migration speed of the charged particles depending on a variation in temperature may be compensated. However, the burn-in occurring during a time, at which the display is not changed, is not taken into consideration. Moreover, the defect caused due to the variation in temperature may not be sufficiently prevented.

SUMMARY

An advantage of some aspects of the invention is that it provides an electrophoretic display device driving method, an electrophoretic display device, and an electronic apparatus capable of preventing burn-in from occurring.

According to an aspect of the invention, there is provided a method of driving an electrophoretic display device including a display unit in which an electrophoretic element containing electrophoretic particles is interposed between first and second substrates and in which a plurality of pixels are arranged. The method includes lowering a contrast of the display unit, when a predetermined non-operation period elapses after the display unit displays an image.

According to the driving method, when the image is displayed and the predetermined non-operation period elapses, an operation of agitating the electrophoretic particles is executed in effect by changing the contrast. In this way, when the electrophoretic display device is in an environment in which burn-in occurs, it is possible to prevent the electrophoretic particles from being stuck in the electrophoretic display device.

According to the aspect of the invention, since the contrast of the displayed image is just changed and the displayed image is not erased, the displayed image does not disappear while a user uses the electrophoretic display device. The burn-in can be prevented without stress given to the user.

In the lowering of the contrast, a gray scale of at least some of the pixels may be transferred to an intermediate gray scale.

According to the driving method, at least some of the electrophoretic particles can be distant from the vicinity of the electrodes. Accordingly, when the predetermined non-operation period elapses, it is possible to transfer the state of the electrophoretic display device to the state where the burn-in rarely occurs.

In the lowering of the contrast, a gray scale of only the pixels of a specific gray scale may be transferred to the intermediate gray scale. For example, when the specific color electrophoretic particles included in the electrophoretic element are easily particularly stuck, the burn-in can be prevented with the smaller number of operations by using the driving method.

In the lowering of the contrast, the maximum gray scale or the minimum gray scale of only the pixels are transferred to the intermediate gray scale.

When the gray scale value of the display gray scale is maximum or minimum, the electrophoretic particles can be drawn strongly to the electrodes, and thus the burn-in easily occurs. However, by selectively transferring the contrast of only the pixels to the maximum or minimum scales, the burn-in can be prevented with the smaller number of operations.

In the lowering of the contrast, at least some of the pixels may execute a reversing display operation.

According to the driving method, since the contrast can be changed in all of the pixels of plural gray scales, the burn-in can be prevented with the smaller number of operations.

A voltage applied to the electrophoretic element in the lowering of the contrast may be lower than a voltage applied to the electrophoretic element in displaying an image on the display unit.

According to the driving method, the burn-in preventing operation can be executed without disappearance of the image displayed on the display unit.

A voltage application period during which a voltage is applied to the electrophoretic element in the lowering of the contrast may be shorter than a voltage application period during which a voltage is applied to the electrophoretic element in displaying an image on the display unit.

According to the driving method, the burn-in preventing operation can be executed without disappearance of the image displayed on the display unit.

The voltages or a voltage application period may be changed on the basis of an ambient temperature.

According to the driving method, it is possible to execute the burn-in preventing operation in considering a case where the burn-in easily occurs depending on the ambient temperature.

A length of the non-operation period until the lowering is executed may be changed on the basis of an ambient temperature.

According to the driving method, it is possible to execute the burn-in preventing operation in considering a case where the burn-in easily occurs depending on the ambient temperature.

According to another aspect of the invention, there is provided an electrophoretic display device including: a display unit in which an electrophoretic element containing electrophoretic particles is interposed between first and second substrates and in which a plurality of pixels are arranged; and a control unit which controls the display unit. The control unit executes a contrast changing operation of lowering a contrast of the display unit, when a predetermined non-operation period elapses after the display unit displays an image.

With such a configuration, when the image is displayed and the predetermined non-operation period elapses, an operation of agitating the electrophoretic particles is executed in effect by changing the contrast. In this way, when the electrophoretic display device is in an environment in which burn-in occurs, it is possible to prevent the electrophoretic particles from being stuck in the electrophoretic display device.

According to the aspect of the invention, since the contrast of the displayed image is just changed and the displayed image is not erased, the displayed image does not disappear while the user uses the electrophoretic display device. The burn-in can be prevented without stress given to the user.

In the contrast changing operation, the control unit may transfer a gray scale of at least some of the pixels to an intermediate gray scale.

With such a configuration, at least some of the electrophoretic particles can be distant from the vicinity of the electrodes. Accordingly, when the predetermined non-operation period elapses, it is possible to transfer the state of the electrophoretic display device to the state where the burn-in rarely occurs.

A voltage applied to the electrophoretic element in the contrast changing operation may be lower than a voltage applied to the electrophoretic element in an image displaying operation of displaying an image on the display unit.

With such a configuration, the burn-in preventing operation can be executed without disappearance of the image displayed on the display unit.

A voltage application period during which a voltage is applied to the electrophoretic element in the contrast changing operation may be shorter than a voltage application period during which a voltage is applied to the electrophoretic element in an image displaying operation of displaying an image on the display unit.

With such a configuration, the burn-in preventing operation can be executed without disappearance of the image displayed on the display unit.

The control unit may change the voltages or a voltage application period on the basis of an ambient temperature.

With such a configuration, it is possible to realize the electrophoretic display device capable of executing the burn-in preventing operation in considering a case where the burn-in easily occurs depending on the ambient temperature.

On the basis of an ambient temperature, the control unit may change a length of the non-operation period until the contrast changing operation is executed.

With such a configuration, it is possible to realize the electrophoretic display device capable of executing the burn-in preventing operation in considering a case where the burn-in easily occurs depending on the ambient temperature.

According to still another aspect of the invention, there is provided an electronic apparatus including the above-described electrophoretic display device.

With such a configuration, it is possible to provide an electronic apparatus including a display device capable of preventing the burn-in and excellent in reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an electrophoretic display device and a driving method of the same according to the embodiment of the invention will be described with reference to the drawings.

The embodiment is just an exemplary example of the invention. The invention is not limited to this embodiment, but may be modified in various forms within the technical scope of the invention. In order to enable easy description of elements in the accompanying drawings, the elements are appropriately shown with different scales and in different numbers.

Figure 1:
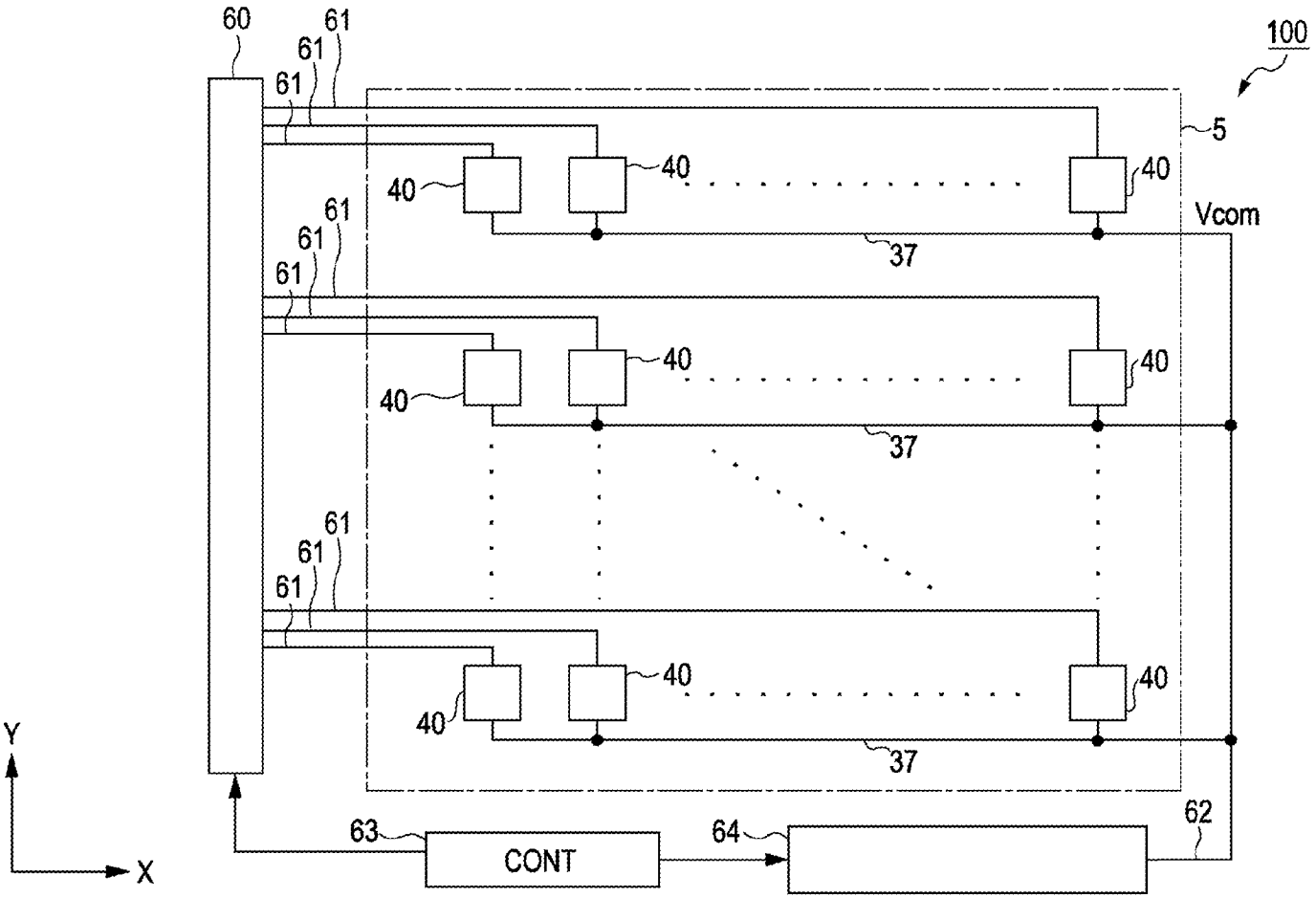
FIG. 1 is a schematic diagram illustrating the configuration of an electrophoretic display device according to an embodiment.
Figure 2A:
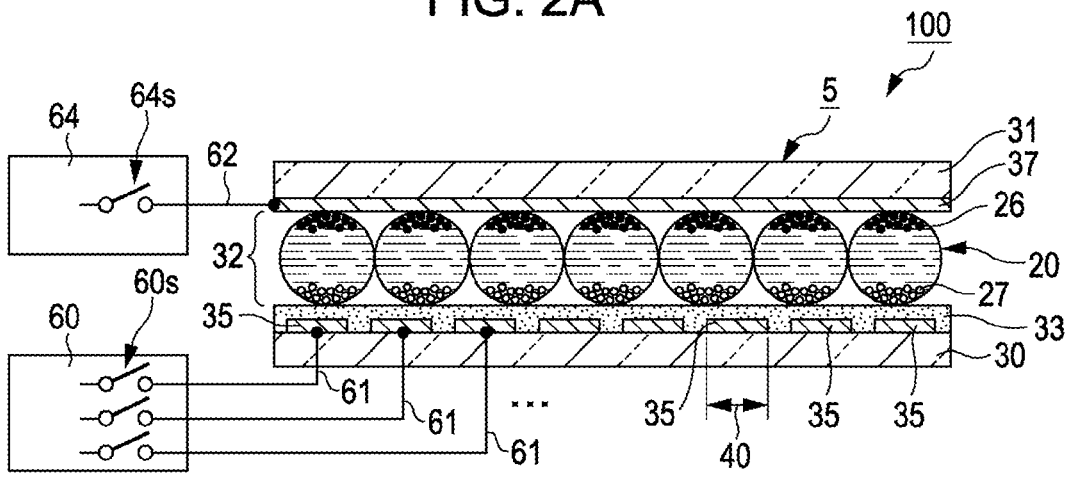
FIGS. 2A and 2B are diagrams illustrating the sectional configuration and the electric configuration of the electrophoretic display device.

FIG. 1 is a schematic diagram illustrating the configuration of an electrophoretic display device 100 according to an embodiment of the invention. FIG. 2A is a diagram illustrating the sectional configuration and the electric configuration of the electrophoretic display device 100.

The electrophoretic display device 100 includes a display unit 5 in which a plurality of pixels (segments) 40 is arranged, a controller (control unit) 63, and a pixel electrode driving circuit 60 connected to the controller 63. The pixel electrode driving circuit 60 is connected to pixels 40 via pixel electrode wires 61. A common electrode 37 (see FIGS. 2A and 2B) common to the pixels 40 is disposed in the display unit 5. In FIG. 1, the common electrode 37 is simply illustrated by a wire.

The electrophoretic display device 100 is a segment driving type electrophoretic display device which transmits image data from the controller 63 to the pixel electrode driving circuit 60 and directly inputs potential based on the image data to the respective pixels 40.

As shown in FIG. 2A, the display unit 5 of the electrophoretic display device 100 which interposes an electrophoretic element 32 between a first substrate 30 and a second substrate 31. A plurality of pixel electrodes (segment electrode: first electrode) 35 is formed on the first substrate 30 close to the electrophoretic element 32. In addition, the common electrode (second electrode) 37 is formed on the second substrate 31 close to the electrophoretic element 32. In the electrophoretic element 32, a plurality of microcapsules 20 enclosing electrophoretic particles therein is arranged in a planar shape. The electrophoretic display device 100 displays an image formed by the electrophoretic element 32 on the side of the common electrode 37.

The first substrate 30 is a substrate made of glass, plastic, or the like. The first substrate 30 may not be transparent, since the first substrate 30 is disposed on an opposite side of an image display surface. The pixel electrodes 35 are formed by sequentially laminating a nickel plate and a gold plate on a Cu (copper) foil or formed of Al (aluminum), ITO (Indium Tin Oxide), or the like.

On the other hand, the second substrate 31 is a substrate made of glass, plastic, or the like. The second substrate 31 is transparent, since the second substrate 31 is disposed on the side of the image display surface. The common electrode 37 is a transparent electrode formed of MgAg (magnesium sliver), ITO, IZO (registered trademark: Indium Zinc Oxide), or the like.

The pixel electrode driving circuit 60 is connected to the pixel electrodes 35 via the pixel electrode wires 61. Since switching elements 60*s* respectively connected to the pixel electrode wires 61 are installed in the pixel electrode driving circuit 60, the switching elements 60*s* operate to input potential to the pixel electrodes 35 and to electrically interrupt the input (high impedance) to the pixel electrodes 35.

On the other hand, a common electrode driving circuit 64 is connected to the common electrode 37 via a common electrode wire 62. Since a switching element 64*s* connected to the common electrode wire 62 is installed in the common electrode driving circuit 64, the switching elements 64*s* operate to input potential to the common electrode 37 and to electrically interrupt the input (high impedance) to the common electrode 37.

The electrophoretic element 32 is formed in advance close to the second substrate 31 and is generally treated as an electrophoretic sheet including the adhesive layer 33. In the manufacturing process, the electrophoretic sheet is treated in a state where a protective peeling sheet is bonded to the surface of the adhesive layer 33. The display unit 5 is formed by bonding the electrophoretic sheet, from which the protective peeling sheet is removed, to the first substrate 30 (on which the pixel electrodes 35 and the like are formed) manufactured independently. Accordingly, the adhesive layer 33 exists on only the side close to the pixel electrodes 35.

Figure 2B:
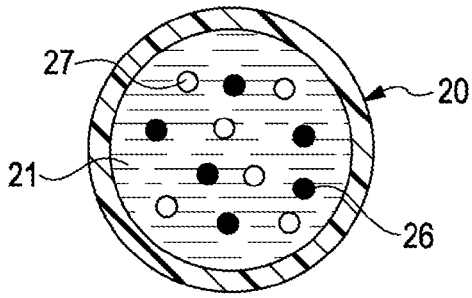

FIG. 2B is a schematic sectional view illustrating the microcapsule 20. The microcapsule 20 has a particle diameter from about 30 μm to about 50 μm, for example, and is a spherical member in which a dispersion medium 21, plural white particles (electrophoretic particles) 27, and plural black particles (electrophoretic particles) 26 are enclosed. As shown in FIGS. 2A and 2B, the microcapsules 20 are interposed between the common electrode 37 and the pixel electrodes 35 and one or plural microcapsules 20 are disposed in one pixel 40.

The outer shell (wall membrane) of the microcapsule 20 is formed of transparent polymer resin such as acryl resin such as polymethyl methacrylate and polyethyl methacrylate, urea resin, and gum Arabic.

The dispersion medium 21 is a liquid for dispersing the white particles 27 and the black particles 26 in the microcapsule 20. Examples of the dispersion medium 21 include water, alcoholic solvent (such as methanol, ethanol, isopropanol, butanol, octanol, and methyl cellosolve), esters (such as ethyl acetate and butyl acetate), ketones (such as acetone, methylethyl ketone, and methyl isobutyl ketone), aliphatic hydrocarbons (such as pentane, hexane, and octane), alicyclic hydrocarbons (such as cyclohexane and methyl cyclohexane), aromatic hydrocarbons (such as benzene, toluene, and benzenes having a long-chain alkyl group (such as xylene, hexyl benzene, heptyl benzene, octyl benzene, nonyl benzene, decyl benzene, undecyl benzene, dodecyl benzene, tridecyl benzene, and tetradecyl benzene)), halogenated hydrocarbon (such as methylene chloride, chloroform, carbon tetrachloride, and 1,2-dichloroethane), carboxylate salt, and other oil substances. These materials may be used singly or as a mixture and may be mixed with surfactant and the like.

The white particles 27 are particles (polymer or colloid) formed of white pigments such as titanium dioxide, zinc flower, and antimony trioxide and are charged to, for example, negative polarity for use. The black particles 26 are particles (polymer or colloid) formed of black pigments such as aniline black and carbon black and are charged to, for example, positive polarity for use.

A charging control agent including particles of electrolyte, surfactant, metal soap, resin, rubber, oil, varnish, or compound, a dispersion solvent such as titanium coupling agent, aluminum coupling agent, and silane coupling agent, lubricant, and stabilizer may be added to the pigments as needed.

For example, red, green, and blue pigments may be used instead of the black particles 26 and the white particles 27. In this case, the display unit 5 can display red, green, and blue.

Figure 3A:
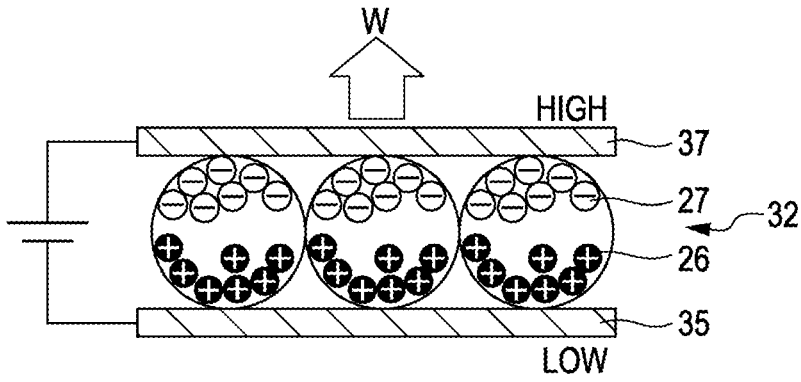
FIGS. 3A and 3B are explanatory diagrams illustrating an operation of an electrophoretic element.
Figure 3B:
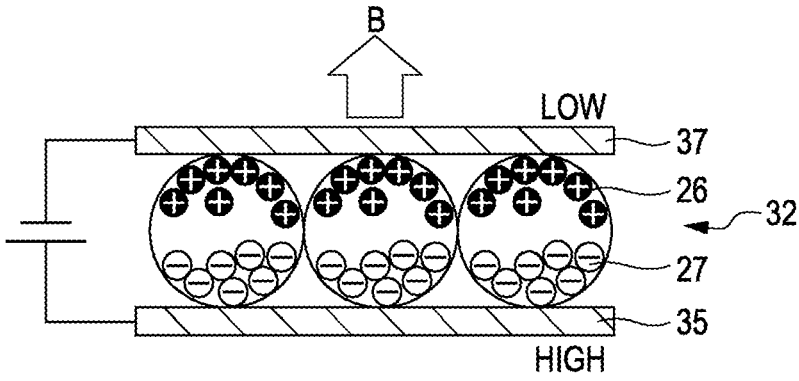

FIGS. 3A and 3B are explanatory diagrams illustrating an operation of an electrophoretic element. FIG. 3A shows a state where the pixel 40 displays white and FIG. 3B shows a state where the pixel 40 displays black.

In the white display shown in FIG. 3A, the common electrode 37 is maintained with the relatively high potential and the pixel electrode 35 is maintained with the relatively low potential. Accordingly, the negatively charged white particles 27 are attracted to the common electrode 37 and the positively charged black particles 26 are attracted to the pixel electrode 35. As a result, when the pixel is viewed from the common electrode 37 serving as the display surface, white (W) is recognized.

In the black display shown in FIG. 3B, the common electrode 37 is maintained with the relatively low potential and the pixel electrode 35 is maintained with the relatively high potential. Accordingly, the positively charged black particles 26 are attracted to the common electrode 37 and the negatively charged white particles 27 are attracted to the pixel electrode 35. As a result, when the pixel is viewed from the common electrode 37, black (B) is recognized.

Figure 4:
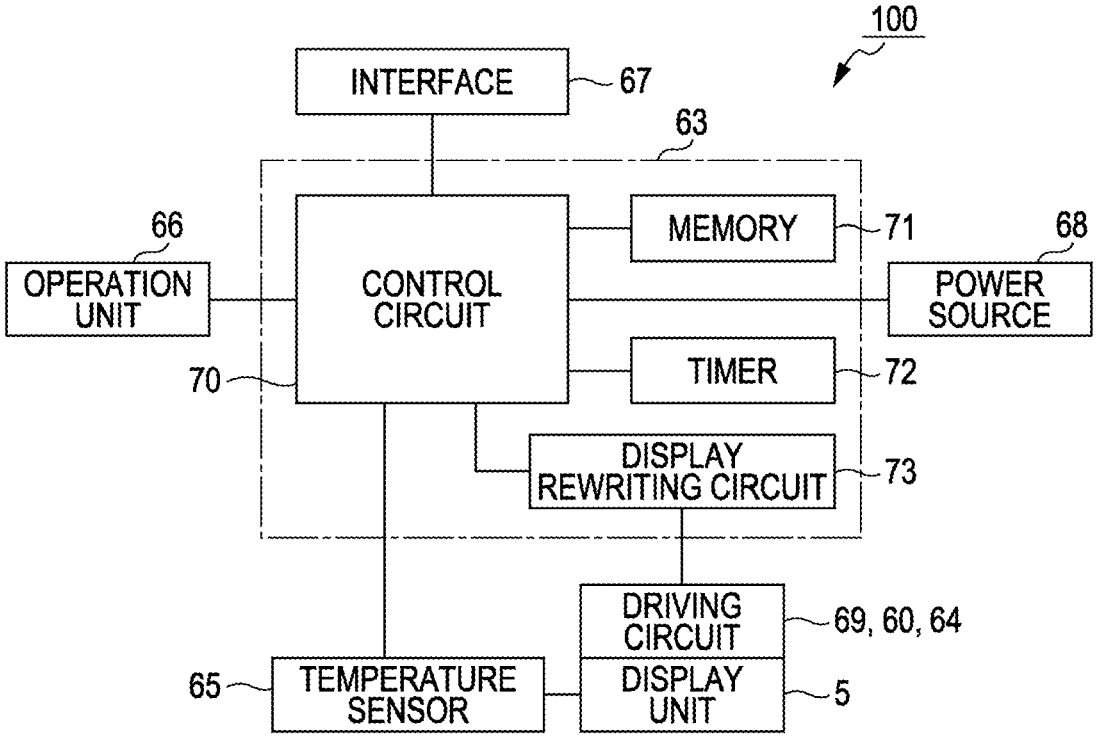
FIG. 4 is a block diagram illustrating functions of the electrophoretic display device.

FIG. 4 is a block diagram illustrating the functions of the electrophoretic display device 100.

The electrophoretic display device 100 includes a controller 63, a temperature sensor 65, an operation unit 66, an interface 67, a power source 68, and a driving circuit 69, as shown in FIG. 4. The driving circuit 69 includes the pixel electrode driving circuit 60 and the common electrode driving circuit 64 shown in FIG. 1 and FIGS. 2A and 2B and is connected to the display unit 5.

The controller 63 includes a control circuit 70, a memory 71 (memory unit), a timer 72, and a display rewriting circuit 73.

The control circuit 70 serves as a CPU (Central Processing Unit) of the electrophoretic display device 100 and controls a variety of operations of the units of the electrophoretic display device 100 as a whole. The control circuit 70 is connected to the memory 71, the timer 72, and the display rewriting circuit 73 within the controller 63. The control circuit 70 is also connected to the temperature sensor 65 (temperature detector), the operation unit 66, the interface 67, and the power source 68 which are installed outside the controller 63.

The memory 71 may be a volatile memory or a non-volatile memory. An SRAM (Static Random Access Memory) or a DRAM (Dynamic Random Access Memory), for example, may be used as the volatile memory. A mask ROM (Read-Only Memory), a flash memory, or a FeRAM (Ferroelectric Random Access Memory), for example, may be used as the non-volatile memory.

The memory 71 stores predetermined image data in which a display image pattern or the like is determined at power-ON time or power-OFF time, an LUT (Look-Up Table) defining a correspondent relationship between temperature information and operational modes, a program for controlling and driving the display unit 5, and the like. The memory 71 also serves as a working memory maintaining temperature information acquired by the temperature sensor 65, operation time information, or the like.

The timer 72 measures desired time independently or under the control of the control circuit 70. The configuration of the timer 72 is not particularly limited. The timer 72 may be included in the controller 63 or may be mounted independently like the temperature sensor 65.

The display rewriting circuit 73 converts image data, which is input to the control circuit 70 via the interface 67 and is transmitted from the control circuit 70, into image data which can be displayed by the pixels 40 of the display unit 5. The image data converted by the display rewriting circuit 73 contains display color information corresponding to the respective pixels 40. The image data generated by the display rewriting circuit 73 is transmitted to the driving circuit 69 (the pixel electrode driving circuit 60 and the common electrode driving circuit 64).

The temperature sensor 65 is a sensor of which an electric value such as a resistance value or a capacitance value is changed in response to temperature. The temperature sensor 65 transmits a detected temperature to the control circuit 70. For example, a thermistor or a thermocouple can be used as the temperature sensor 65. Since a signal input from the temperature sensor 65 to the control circuit 70 is a detected analog signal, it is desirable that the controller 63 or the control circuit 70 has an AD converter capable of executing AD conversion from the detected analog signal to data serving as encoded temperature information.

One or plural temperature sensors 65 may be included in the electrophoretic display device 100 and installed at regions where the temperature of the display unit 5 shown in FIG. 1 and FIGS. 2A and 2B can be measured.

For example, the temperature sensor 65 may be attached to the back surface of the first substrate 30 shown in FIG. 2A. When the planar area of the display unit 5 is large, the temperature sensors 65 may be disposed at two or more regions near the center of the display unit 5 and of the periphery of the display unit 5. When the plural temperature sensors 65 are disposed, a simple average value, a weighted average value, or the maximum value of the plural temperatures measured by the plural temperature sensors 65 may be used as the temperature information acquired by the control circuit 70.

The operation unit 66 is a user interface of the electrophoretic display device 100 through which a user inputs an operation instruction.

The interface 67 is a connection unit of the electrophoretic display device 100 connected to an external apparatus (not shown). The interface 67 transmits image data or a command input from the external apparatus to the control circuit 70 and transmits a response signal or the like output from the control circuit 70 to the external apparatus.

The power source 68 is a battery supplying power to the electrophoretic display device 100 or a power circuit connected to an external power source.

The driving circuit 69 inputs image signals to the pixels 40 on the basis of the image data input from the display rewriting circuit 73. Accordingly, the electrophoretic element 32 of the pixels 40 is driven by the image signals to display an image defined by the image data on the display unit 5.

Driving Method

Next, a method of driving the electrophoretic display device having the above-described configuration will be described.

Figure 5:
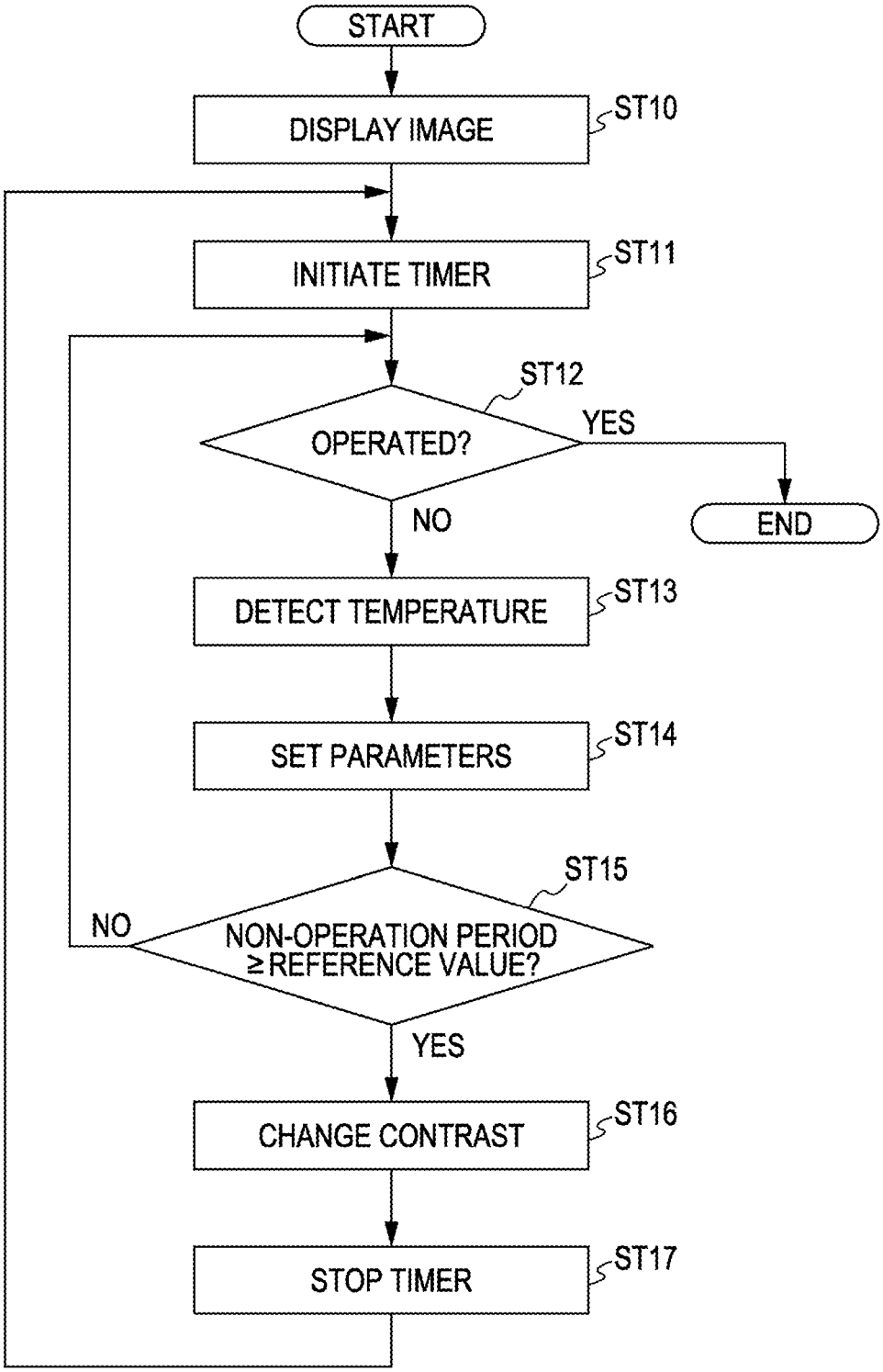
FIG. 5 is a flowchart illustrating a driving method.
Figure 6A:
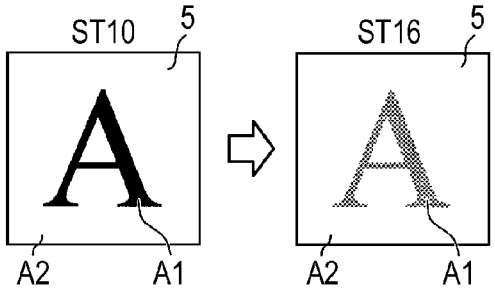
FIGS. 6A and 6B are explanatory diagrams illustrating a driving method according to the invention.
Figure 6B:
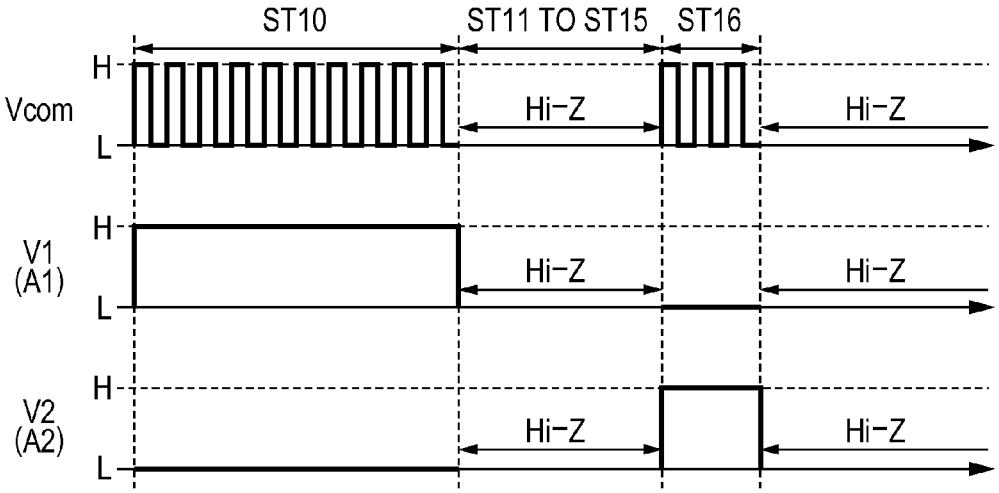

FIG. 5 is a flowchart illustrating a driving method according to this embodiment. FIG. 6A is an explanatory diagram illustrating status transition of the display unit 5 in the driving method according to this embodiment. FIG. 6B is a timing chart of the driving method according to this embodiment.

As shown in FIG. 5, the driving method according to this embodiment includes an image displaying step ST10, a timer initiating step ST11, an operation determining step ST12, a temperature detecting step ST13, a parameter setting step ST14, a non-operation period determining step ST15, a contrast changing step ST16, and a timer stopping step ST17.

First, in the image display step ST10, an image is displayed on the display unit 5. For example, as shown in FIG. 6A, character "A" is displayed on the display unit 5.

The control circuit 70 transmits image data corresponding to character "A" to the display rewriting circuit 73. The display rewriting circuit 73 sequentially transmits a control signal and the converted image data to the driving circuit 69. The potential corresponding to the image data is input to the pixel electrode 35 of each pixel 40 by the driving circuit 69.

First area A1 shown in FIG. 6A corresponds to an area in which a character image of a black display is displayed. Second area A2 corresponds to an area in which a background image of a white display is displayed. In the timing chart shown in FIG. 6B, potential Vcom input to the common electrode 37, potential V1 input to the pixel electrode 35 of the pixels 40 belonging to a first area A1, potential V2 input to the pixel electrode 35 of the pixels 40 belonging to a second area A2 are illustrated.

In the image displaying step ST10, as shown in FIG. 6B, a high-level potential (for example, 15 V) is input to the pixel electrodes 35 belonging to the first area A1 and a low-level potential (for example, 0 V) is input to the pixel electrodes 35 belonging to the second area A2. A rectangular wave pulse in which the high-level potential (for example, 15 V) and the low-level potential (for example, 0 V) are periodically repeated, is input to the common electrode 37.

In the pixels 40 belonging to the first area A1, the electrophoretic element 32 is driven by a potential difference occurring between the pixel electrodes 35 (high-level) and the common electrode 37 and thus the pixels 40 display black for a period during which the potential Vcom of the common electrode 37 is the low level (FIG. 3B).

On the other hand, in the pixels 40 belonging to the second area A2, the electrophoretic element 32 is driven by a potential difference occurring between the pixel electrodes 35 (low-level) and the common electrode 37 and thus the pixels 40 display white for a period during which the potential Vcom of the common electrode 37 is the high level (FIG. 3A).

The image shown in FIG. 6A is displayed on the display unit 5 by the above operations. Subsequently, when a high impedance state where all of the pixel electrodes 35 and the common electrode 37 are electrically cut is formed, the image displaying step ST10 ends and the process proceeds to the timer initiating step ST11.

In the timer initiating step ST11, the control circuit 70 initiates time measurement of the timer 72. The timer 72 may be realized either by software or hardware.

Subsequently, in the operation determining step ST12, it is determined whether a signal is input from the operation unit 66 to the control circuit 70. When it is determined that the signal is not input from the operation unit 66, the temperature detecting step ST13 is selected. Alternatively, when it is determined that the signal is input from the operation unit 66, the series of steps shown in FIG. 5 is terminated (END).

Moreover, when the signal is input from the operation unit 66, the time measurement of the timer 72 is interrupted in effect, and then an image displaying operation based on the signal input from the operation 66, a power control operation, and the like are executed.

For example, when a sending button or a selection button of a page is operated in the operation unit 66 and an image rewriting signal is input from the operation unit 66, the series of steps from the image displaying step ST10 is executed again. For example, when a power button is operated and a power stop signal is input from the operation unit 66, a power stop operation is executed for the control circuit 70.

Alternatively, when the temperature detecting step ST13 is selected, the control circuit 70 acquires temperature information from the output of the temperature sensor 65, maintains the temperature information as the current ambient temperature (the temperature of the display unit 5), and stores the temperature information in an ambient temperature storage area (not shown) of the memory 71. Subsequently, the process proceeds to the parameter setting step ST14.

In the parameter setting step ST14, a non-operation period reference value serving as determination reference used in the non-operation period determining step ST15 and driving parameters of the pixels 40 used in the contrast changing step ST16 are set.

Specifically, an arithmetical operation of using the temperature information (ambient temperature) acquired in the temperature detecting step ST13 or table reference is executed for the control circuit 70. The non-operation period reference value and the driving parameters are set on the basis of this execution result.

The set non-operation period reference value is a reference time which is used when it is determined whether the contrast changing step ST16 is executed in the non-operation period determining step ST15. The set driving parameters are the potential (amplitude) of a pulse input to the pixel electrodes 35 (and the common electrode 37) in the contrast changing step ST16, the width of a pulse, the length of a voltage application period, and the like.

A calculation expression used in the calculation operation of the parameter setting step ST14 is a calculation expression for associating the non-operation period reference value or one or a plurality of driving parameters with the ambient temperature. The table used in the table reference is a table for associating the non-operation period reference value or one or a plurality of driving parameters with the ambient temperature.

In the electrophoretic display device 100 according to this embodiment, as the ambient temperature is higher, a burn-in degree becomes higher and a time until the occurrence of the burn-in becomes shorter. The calculation expression and the table are set on the basis of this tendency. For example, as shown in Table 1, the non-operation period reference value, the amplitude of the pulse, the width of the pulse, and the voltage application period, or the like are set for the ambient temperature.

TABLE 1

| AMBIENT TEMPERATURE | NON-OPERATION PERIOD REFERENCE VALUE | AMPLITUDE OF PULSE | WIDTH OF PULSE | VOLTAGE APPLICATION PERIOD |
|---|---|---|---|---|
| HIGH | SMALL | LARGE | LARGE | LARGE |
| ↑ | ↑ | ↑ | ↑ | ↑ |
| ↓ | ↓ | ↓ | ↓ | ↓ |
| LOW | LARGE | SMALL | SMALL | SMALL |

In the example shown in Table 1, the ambient temperature is associated with the non-operation period reference value so that the non-operation period reference value becomes smaller as the ambient temperature is higher. The amplitude of the pulse input to the electrophoretic element 32, the width of the pulse, and the voltage application period are associated with the non-operation period reference value so that the amplitude of the pulse, the width of the pulse, and the voltage application period become larger as the ambient temperature is higher in the contrast changing step ST16. The calculation expression or the table is set by combining one or a plurality of the amplitude of the pulse, the width of the pulse, and the voltage application period.

In the parameter setting step ST14, the non-operation period reference value used in the non-operation period determining step ST15 and one or a plurality of the amplitude of the pulse, the width of the pulse, and the voltage application period, which are the driving parameters of the pixels 40, used in the contrast changing step ST16 are calculated or obtained and then set by the calculation operation and the table reference of using the temperature information acquired in the temperature detecting step ST13.

Subsequently, in the non-operation period determining step ST15, the measurement result (non-operation period) of the timer 72 the non-operation period reference value set in the parameter setting step ST14 are compared to each other for the control circuit 70. When the non-operation period is equal to or larger than the non-operation period reference value, the contrast changing step ST16 is selected as the result of the comparison. Alternatively, when the non-operation period does not reach the non-operation period reference value, the process returns to the operation determining step ST12 and then the observation operation of the operation unit 66 resumes.

When the contrast changing step ST16 is selected, as shown in FIG. 6B, the low-level potential is input to the pixel electrodes 35 belonging to the first area A1 and the high-level potential is input to the pixel electrodes 35 belonging to the second area A2. The rectangular wave pulse in which the high-level potential (for example, 15 V) and the low-level potential (for example, 0 V) are periodically repeated, is input to the common electrode 37.

That is, an operation of displaying a monochrome reversing image of the image data on the display unit 5 used in the image displaying step ST10 is executed.

In the contrast changing step ST16, the pixels 40 belonging to the first area A1 display white and the pixels 40 belonging to the second area A2 display black. However, since the voltage application period in the contrast changing step ST16 is shorter than the voltage application period in the image displaying step ST10, the display of the pixels 40 belonging to the first area A1 displaying black does not become white but dark gray (intermediate gray scale display). The display of the pixels 40 belonging to the second area A2 displaying white does not become black but light gray.

In the timing chart shown in FIG. 6B, the amplitude of the pulse or the width of the pulse are the same as those in the image displaying step ST10. However, when the amplitude of the pulse or the width of the pulse is changed in the parameter setting step ST14, the driving parameter is also changed. For example, when the ambient temperature is changed to be relatively low and the amplitude of the pulse is changed to be small, the high-level potential input to the pixel electrodes 35 and the common electrode 37 is changed from 15 V to 10 V, for example. Alternatively, when the ambient temperature is changed to be relatively high and the amplitude of the pulse is changed to be large, the width of the wave pulse input to the common electrode 37 is changed from 20 ms to 50 ms, for example.

By the above operations, an image of which the contrast is lowered as a whole is displayed on the display unit 5, as shown in FIG. 6A. Subsequently, when the high impedance state where all of the pixel electrodes 35 and the common electrode 37 are electrically cut is formed, the contrast changing step ST16 ends and the process proceeds to the timer stopping step ST17.

Subsequently, the timer 72 stops in the timer stopping step ST17, and then the process returns to the timer initiating step ST11. Subsequently, steps ST11 to ST17 are repeatedly executed and the contrast changing step ST16 is executed whenever the non-operation period corresponding to the ambient temperature elapses.

In the above-described driving method according to this embodiment, by executing the contrast changing step ST16 after the elapse of the non-operation period set to correspond to the ambient temperature, some of the electrophoretic particles (the black particles 26 and the white particles 27) which are likely to be drawn toward the wall membranes of the microcapsules 20 in the image displaying step ST10 can be distant from the wall membranes of the microcapsules 20. In this way, when the same image is displayed for a long time, the electrophoretic particles of the microcapsules 20 can be prevented from being stuck to the wall membranes of the microcapsules 20. Accordingly, the occurrence of the burn-in can be prevented effectively.

In the driving method according to this embodiment, since the displayed image is not erased, but is changed to have the low contrast, the burn-in is prevented. Accordingly, the displayed image does not disappear and the same image can continuously be displayed so as to be suitable for use.

In a driving method of erasing the displayed image to prevent the burn-in, the image suddenly disappears while a user views the image and thus the user may feel stress. In this embodiment, however, since the displayed image does not disappear, the burn-in can be prevented without stress given to the user.

In the driving method according to this embodiment, the non-operation period reference value used in the non-operation period determining step ST15 is set on the basis of the ambient temperature in the temperature detecting step ST13 and the parameter setting step ST14. Accordingly, since the contrast changing step ST16 can be executed at an appropriate time, power consumption can be reduced and the burn-in can be prevented.

More specifically, the burn-in occurring when the electrophoretic particles are stuck to the wall membranes of the microcapsules 20, as described above, show a tendency to occur depending on the ambient temperature. That is, the burn-in rarely occurs at relatively low temperature, but easily occurs at relatively high temperature. Accordingly, when the non-operation period reference value is fixed to a value suitable for a high temperature environment, for example, the unnecessary contrast changing step is executed and thus unnecessary power consumption may occur in the case where the ambient temperature is relatively low. Alternatively, when the non-operation period reference value is fixed to a value suitable for a low temperature environment, the burn-in may occur at a high temperature environment.

In this embodiment, however, since the contrast changing step ST16 can be selectively executed depending on the ambient temperature, the above-mentioned unnecessary power consumption can be inhibited and the burn-in can be prevented.

In the driving method according to this embodiment, the driving parameters used in the contrast changing step ST16 are set on the basis of the ambient temperature in the temperature detecting step ST13 and the parameter setting step ST14. Accordingly, the electrophoretic element 32 can be driven in an appropriate range in which the burn-in can be prevented.

More specifically, the burn-in easily occurs at relatively high temperature. Accordingly, when the voltage applied to the electrophoretic element 32 is too low or the voltage application period is too short in the contrast changing step ST16, the operation of separating the electrophoretic particles from the wall membranes of the microcapsules 20 is not sufficient and thus the burn-in may occur. Alternatively, when the contrast is excessively changed in the contrast changing step, the visibility of the displayed image may deteriorate.

In this embodiment, however, since the contrast is appropriately changed depending on the ambient temperature, the burn-in can be prevented without depending on the ambient temperature and the maximum contrast can be obtained in the range in which the burn-in can be prevented.

In the driving method according to this embodiment, after the contrast changing step ST16 is executed, the timer 72 is reset and the observation of the operation unit 66 resumes. In this way, the burn-in can be prevented for a period longer than the non-operation period reference value.

In the timer stopping step ST17 after the contrast changing step ST16 is executed once or several times, the series of operations can be terminated. For example, when a sequence of erasing the image of the display unit 5 after elapse of a predetermined non-operation period or a sequence of stopping power is provided, it is not necessary to change the contrast. Accordingly, the operations can be terminated.

In this embodiment, when the display of the first area A1 is black and the display of the second area A2 is white, the entire contrast of the display unit 5 is changed by writing a reversing image to the display unit 5. In this way, since the contrast can be changed in all of the pixels 40 of the plural display gray scales, the burn-in can be prevented with the smaller number of operations.

In the driving method according to this embodiment, the contrast can be changed in a part of the display unit 5. In this embodiment, both the black display of the first area A1 and the white display of the second area A2 are transferred to the gray display in the contrast changing step ST16. However, for example, either the black display of the first area A1 or the white display of the second area A2 may be transferred to the gray display.

More specifically, when the black particles 26 are more easily stuck to the wall membranes of the microcapsules 20 than the white particles 27, only the black display of the first area A1 may be transferred to the gray display. In this case, the pixel electrodes 35 belonging to the second area A2 may become the high impedance state in the contrast changing step ST16 shown in FIG. 6B.

For example, when the display of the first area A1 is black and the display of the second area A2 is gray for the image displayed in the image displaying step ST10, the contrast may be changed only in the first area A1 where the gray scale value is maximum (minimum). When the gray scale value of the display gray scale is maximum or minimum, the electrophoretic particles can be drawn strongly to the electrodes, and thus the burn-in easily occurs. However, by selectively transferring the pixels 40 to the intermediate gray scales, the burn-in can be prevented with the smaller number of operations.

In this embodiment, when the signal is input from the operation unit 66 in the operation determining step ST12, the series of operations is terminated. However, a contrast recovering step of recovering the contrast lowered in the contrast changing step ST16 may be executed in accordance with the signal input from the operation unit 66.

For example, when a status return button for cancelling the standby status is installed in the operation unit 66 or a sequence of retuning the process from the standby status by the operation of a selection button or a power button is provided, the contrast recovering step may be executed at the returning time from the standby status.

In the contrast recovering step, an operation like the image displaying step ST10 may be executed. However, when the contrast is slightly lowered by execution of the contrast changing step ST16 by the display unit 5, it is desirable that the contrast is recovered using the same driving parameters as the driving parameters used in the contrast changing step ST16.

That is, it is desirable that the image displaying operation is executed using the same amplitude of the pulse, the same width of the pulse, and the same voltage application period as those used in the contrast changing step ST16. In this way, it is possible to prevent an excess writing operation for the display unit 5 in the low contrast state in the contrast changing step ST16.

In this embodiment, the segment type electrophoretic display device has been described, but the driving method according to this embodiment is suitably used also in an active matrix type electrophoretic display device. That is, the electrophoretic display device according to the invention may be realized as an SRAM (Static Random Access Memory) type electrophoretic display device in which a latch circuit is disposed in every pixel or a DRAM (Dynamic Random Access Memory) type electrophoretic display device in which a selection transistor and a capacitor are disposed in every pixel.

Electronic Apparatuses

Next, a case where the electrophoretic display device 100 is applied to an electronic apparatus will be described.

Figure 7:
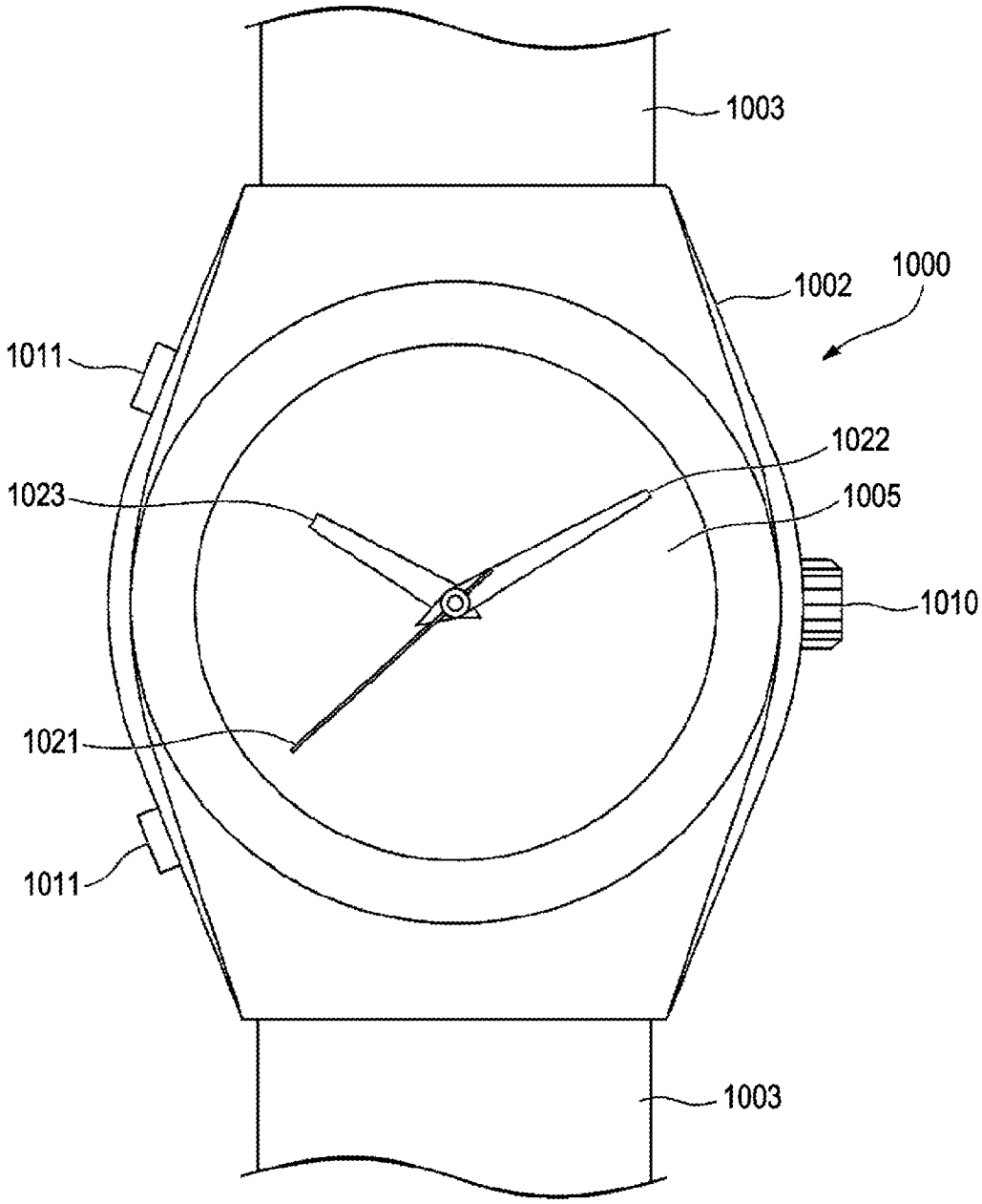
FIG. 7 is a diagram illustrating an example of an electronic apparatus.

FIG. 7 is a front view illustrating a wrist watch 1000. The wrist watch 1000 includes a watch case 1002 and a pair of bands 1003 connected to the watch case 1002.

A display unit 1005 made from the electrophoretic display device 100 according to the above-described embodiment, a second hand 1021, a minute hand 1022, and an hour hand 1023 are installed on the front of the watch case 1002. A winder 1010 serving as an operator and operational buttons 1011 are installed on the side of the watch case 1002. The winder 1010 is connected to a winding brass (not shown) installed inside the case so as to be integrated with the winding brass and is installed so as to be pressed at multi steps (for example, two steps) and so as to be rotatable. A background image, a character line such as a date or a time, a second hand, a minute hand, an hour hand, and the like can be displayed on the display unit 1005.

Figure 8:
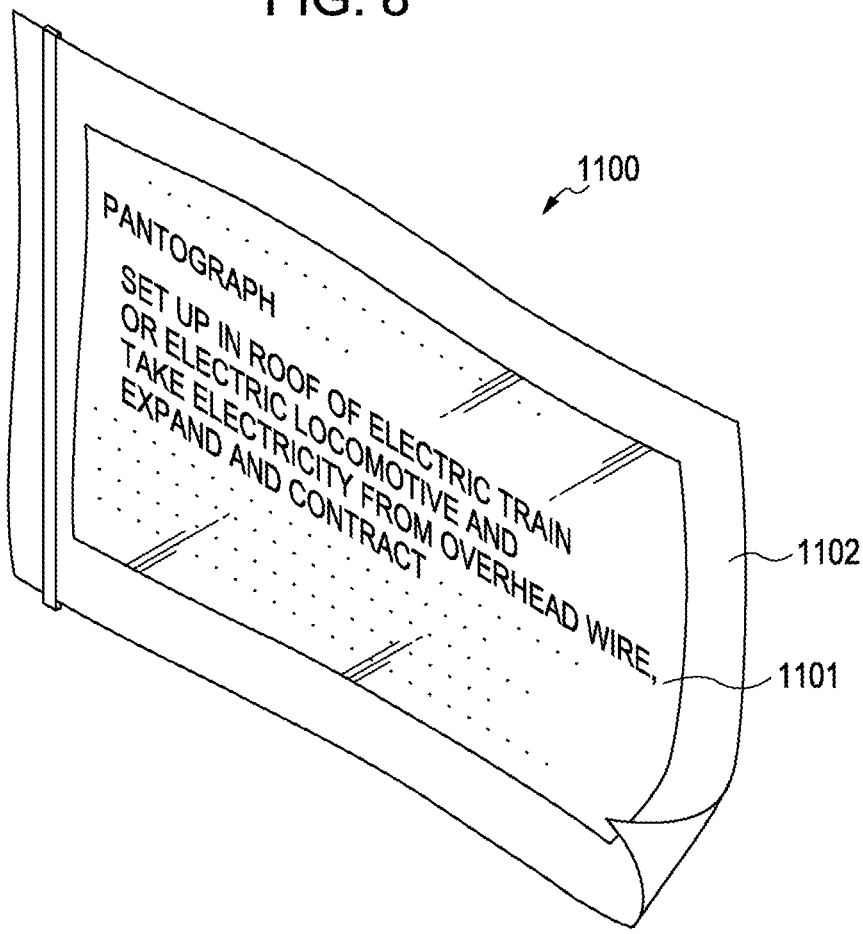
FIG. 8 is a diagram illustrating an example of an electronic apparatus.

FIG. 8 is a perspective view illustrating the configuration of an electronic paper 1100. The electronic paper 1100 includes the electrophoretic display device 100 according to the above-described embodiment in a display area 1101. The electronic paper 1100 has flexibility and includes a main body 1102 formed of a rewritable sheet having texture and flexibility like known paper.

Figure 9:
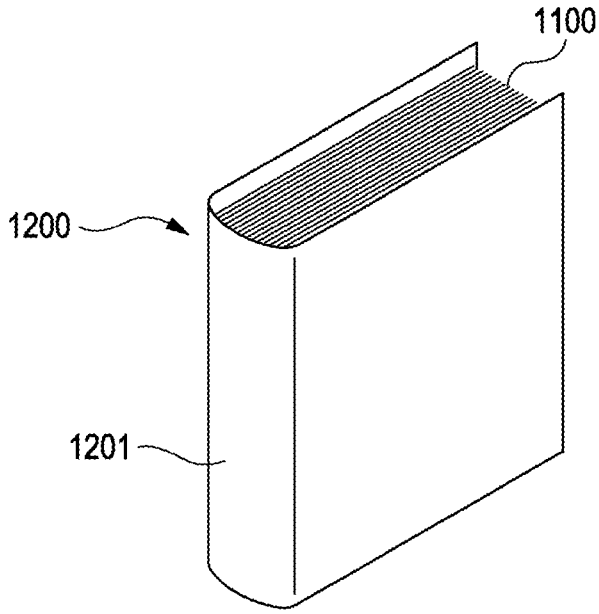
FIG. 9 is a diagram illustrating an example of an electronic apparatus.

FIG. 9 is a perspective view illustrating the configuration of an electronic notebook 1200. The electronic notebook 1200 is made by binding plural sheets of electronic paper 1100 and attaching a cover 1201. The cover 1201 includes a display data inputting unit (not shown) which inputs display data transmitted from an external apparatus, for example. With such a configuration, display details can be changed or updated in accordance with the display data with the bound electronic paper.

Since the electrophoretic display device 100 according to the invention is used in the wrist watch 1000, the electronic paper 1100, and the electronic notebook 1200, the electronic apparatuses including the display device capable of maintaining a display quality for a long time and being excellent in reliability can be realized.

The electronic apparatuses are just examples according to the invention and do not limit the technical scope of the invention. For example, the electrophoretic display device according to the invention is also applicable to a display device of an electronic apparatus such as a portable telephone or a portable audio apparatus.

The entire disclosure of Japanese Patent Application No. 2009-070191, filed Mar. 23, 2009 is expressly incorporated by reference herein.

What is claimed is:

1. A method of driving an electrophoretic display device including a display unit in which an electrophoretic element containing electrophoretic particles is interposed between first and second substrates and in which a plurality of pixels are arranged, the method comprising:

detecting a non-operation period during which an electric potential is not input to pixel electrodes of the plurality of pixels after the display unit displays an image;

determining that the non-operation period exceeds a predetermined reference value;

lowering a contrast of the display unit by applying voltages to the pixel electrodes after determining that the non-operation period exceeds the predetermined reference value, wherein a voltage applied to the electrophoretic element in the lowering of the contrast is reverse polarity to a voltage applied to the electrophoretic element in displaying an image on the display unit.

2. The method according to claim 1, wherein in the lowering of the contrast, a gray scale of at least some of the pixels is transferred to an intermediate gray scale.

3. The method according to claim 2, wherein in the lowering of the contrast, a gray scale of only the pixels of a specific gray scale is transferred to the intermediate gray scale.

4. The method according to claim 3, wherein in the lowering of the contrast, the maximum gray scale or the minimum gray scale of only the pixels are transferred to the intermediate gray scale.

5. The method according to claim 1, wherein in the lowering of the contrast, at least some of the pixels execute a reversing display operation.

6. The method according to claim 1, wherein a voltage applied to the electrophoretic element in the lowering of the contrast is lower than a voltage applied to the electrophoretic element in displaying an image on the display unit.

7. The method according to claim 6, wherein the voltages or a voltage application period is changed on the basis of an ambient temperature.

8. The method according to claim 1, wherein a voltage application period during which a voltage is applied to the electrophoretic element in the lowering of the contrast is shorter than a voltage application period during which a voltage is applied to the electrophoretic element in displaying an image on the display unit.

9. The method according to claim 1, wherein a length of the non-operation period until the lowering is executed is changed on the basis of an ambient temperature.

10. The method according to claim 1, wherein:

the lowering the contrast of the display unit further comprises lowering the contrast of the display unit by applying a first voltage to the pixel electrodes in a first area and a second voltage to the pixel electrodes in a second area after determining that the non-operation period exceeds the predetermined reference value, and the first voltage value is different than the second voltage value.

11. An electrophoretic display device comprising:

a display unit in which an electrophoretic element containing electrophoretic particles is interposed between first and second substrates and in which a plurality of pixels are arranged; and a control unit which controls the display unit, wherein the control unit:

detects a non-operation period during which an electric potential is not input to pixel electrodes of the plurality of pixels after the display unit displays an image;

determines that the non-operation period exceeds a predetermined reference value;

executes a contrast changing operation of lowering a contrast of the display unit by applying voltages to the pixel electrodes after determining that the non-operation period exceeds the predetermined reference value, wherein a voltage applied to the electrophoretic element in the lowering of the contrast is reverse polarity to a voltage applied to the electrophoretic element in displaying an image on the display unit.

12. The electrophoretic display device according to claim 11, wherein in the contrast changing operation, the control unit transfers a gray scale of at least some of the pixels to an intermediate gray scale.

13. The electrophoretic display device according to claim 11, wherein a voltage applied to the electrophoretic element in the contrast changing operation is lower than a voltage applied to the electrophoretic element in an image displaying operation of displaying an image on the display unit.

14. The electrophoretic display device according to claim 13, wherein the control unit changes the voltages or a voltage application period on the basis of an ambient temperature.

15. The electrophoretic display device according to claim 11, wherein a voltage application period during which a voltage is applied to the electrophoretic element in the contrast changing operation is shorter than a voltage application period during which a voltage is applied to the electrophoretic element in an image displaying operation of displaying an image on the display unit.

16. The electrophoretic display device according to claim 11, wherein on the basis of an ambient temperature, the control unit changes a length of the non-operation period until the contrast changing operation is executed.

17. An electronic apparatus comprising the electrophoretic display device according to claim 11.

18. The electrophoretic display device according to claim 11, wherein:

the control unit executes the contrast changing operation of lowering the contrast of the display unit by applying a first voltage to the pixel electrodes in a first area and a second voltage to the pixel electrodes in a second area after determining that the non-operation period exceeds the predetermined reference value, and the first voltage value is different than the second voltage value.

19. A method of driving an electrophoretic display device including a display unit in which an electrophoretic element containing electrophoretic particles is interposed between first and second substrates and in which a plurality of pixels are arranged, the method comprising:

detecting a non-operation period during which an electric potential is not input to pixel electrodes of the plurality of pixels after the display unit displays an image;

determining that the non-operation period exceeds a predetermined reference value; and lowering a contrast of the display unit by applying a first voltage to the pixel electrodes in a first area and a second voltage to the pixel electrodes in a second area after determining that the non-operation period exceeds the predetermined reference value, wherein the first voltage value is different than the second voltage value.

20. An electrophoretic display device comprising:

a display unit in which an electrophoretic element containing electrophoretic particles is interposed between first and second substrates and in which a plurality of pixels are arranged; and a control unit which controls the display unit, wherein the control unit:

detects a non-operation period during which an electric potential is not input to pixel electrodes of the plurality of pixels after the display unit displays an image, determines that the non-operation period exceeds a predetermined reference value, and executes a contrast changing operation of lowering a contrast of the display unit by applying a first voltage to the pixel electrodes in a first area and a second voltage to the pixel electrodes in a second area after determining that the non-operation period exceeds the predetermined reference value, the first voltage value being different than the second voltage value.

* * * * *